US006691317B2

(12) United States Patent
Cochran

(10) Patent No.: US 6,691,317 B2
(45) Date of Patent: Feb. 17, 2004

(54) FIREFIGHTER PROTECTIVE GARMENT HAVING A LINER WITH A SEPARABLE MOISTURE BARRIER

(75) Inventor: Ross Cochran, Westmount (CA)

(73) Assignee: Marcanada, Montreal (CA)

( * ) Notice: Subject to any disclaimer, the term of this patent is extended or adjusted under 35 U.S.C. 154(b) by 0 days.

(21) Appl. No.: 09/864,882

(22) Filed: May 25, 2001

(65) Prior Publication Data

US 2002/0174476 A1 Nov. 28, 2002

(51) Int. Cl.[7] ..... A41D 13/00
(52) U.S. Cl. ..... 2/97; 2/81
(58) Field of Search ..... 2/456, 457, 458, 2/49.4, 49.5, 69, 81, 93, 97, 102, 108, 70, 904, 915, 272, 164, 126, DIG. 2

(56) References Cited

U.S. PATENT DOCUMENTS

| | | | | | |
|---|---|---|---|---|---|
| 4,768,233 | A | * | 9/1988 | Grilliot et al. | 2/81 |
| 5,136,723 | A | * | 8/1992 | Aldridge et al. | 2/81 |
| 5,655,222 | A | | 8/1997 | Grilliot et al. | |
| 5,933,865 | A | * | 8/1999 | Aldridge | 2/81 |
| 6,339,843 | B1 | * | 1/2002 | Grilliot et al. | 2/81 |

* cited by examiner

*Primary Examiner*—Tejash Patel
(74) *Attorney, Agent, or Firm*—Swabey Ogilvy Renault; Paul Marcoux

(57) ABSTRACT

The liner according to the invention is designed such that the moisture barrier component of the liner may be easily separated from the garment for inspection, testing, repair or replacement. In the preferred embodiment of the invention, the moisture barrier is attached to the thermal barrier or the outer shell component by means of a heat and flame resistant slide fastener.

4 Claims, 3 Drawing Sheets

FIREFIGHTER PROTECTIVE GARMENT HAVING A LINER WITH A SEPARABLE MOISTURE BARRIER

BACKGROUND OF THE INVENTION (a) Field of the Invention

This invention relates to the method of attachment of the moisture barrier in a firefighter's protective garment. More particularly, the present invention is concerned with a discrete moisture barrier that is attached to the thermal barrier or the outer shell, or both, by means of a slide fastener system.

(b) Description of Prior Art

A firefighter protective garment is usually a coat, a pant or one-piece coverall consisting of three or more functional layers of fire-resistant materials. The various layers are normally the following:

- the outer shell which provides protection against puncture, cuts, abrasion, and heat,
- the moisture barrier—consisting usually of a woven or non-woven substrate to which a fire resistant semi-permeable polymer is coated or laminated—which provides resistance to penetration by liquids and blood-borne pathogens while facilitating the transmission of metabolic heat away from the body of the firefighter;
- the thermal barrier—usually consisting of an insulating layer of batting or non-woven fabric quilted or laminated to a woven face cloth-which provides the bulk of the resistance to the transmission of heat from the external environment to the body of the firefighter.

A common configuration and orientation of these layers in a firefighter garment is as follows:

The outermost layer is the outer shell fabric. Moving inwards, the next functional layer is the moisture barrier, orientated with the substrate towards the outer shell and the polymer towards the inside. The next functional layer is the thermal barrier, orientated with the thicker and softer insulating layer facing the moisture barrier film and the face cloth towards the body of the firefighter.

An alternative configuration reverses the order of the thermal barrier and the moisture barrier such that the moisture barrier is the innermost layer. In this alternative configuration, the substrate of the moisture barrier is closest to the wearer of the garment and the moisture barrier polymer is facing outwards. Furthermore, the thermal barrier is positioned such that the batting or nonwoven thermal insulating layer is immediately adjacent to the moisture barrier polymer.

In both these orientations, it will be noted that the moisture barrier polymer is never directly exposed to the inner or outer environment of the garment. Furthermore, the moisture barrier polymer is normally cushioned and protected by the soft thermal insulation of the thermal barrier.

The polymer is normally less than 100 microns thick. Chemically, it is usually from the family of polytetrafluoroethylene (PTFE), polyurethane, polyamide, or polyimide, used either singly or in combination. It may be microporous, hydrophilic or both. Because of its chemical composition and because of its thinness, the moisture barrier polymer is very fragile. It can be easily damaged, or its performance impaired, by heat, hard or sharp objects, some common chemicals, and by soiling. It can even be damaged by the fingernails or jewelry of the operators who handle the moisture barrier during the assembly of the garment.

In order to prevent an inadvertent exposure of the moisture barrier to either the external or internal environment of the garment, or to prevent potentially damaging foreign material from coming into contact with the polymer, the moisture barrier is normally sewn to the thermal barrier along the entirety of their common periphery and is orientated such that the polymer is on the inside of the resulting sandwich. In most firefighter protective garments worn in North America, the thermal and moisture barriers are sewn together to form what is commonly called "the liner". The liner is usually attached to the outer shell fabric by means of snaps, slide fasteners, or hook-and-pile fastener tape. These means of attachment permit the removal of the liner from the garment, principally to facilitate laundry or repairs.

In some designs of garments, particularly those manufactured in Europe, the moisture barrier and thermal barrier are permanently sewn to the outer shell.

Irrespective of whether the liner is removable or permanently attached to the outer shell fabric, in no instances, is it possible to detach or re-attach the moisture barrier to the thermal barrier or the outer shell without removing the stitching and then sewing a new or repaired moisture barrier back into place.

The firefighter garment, including its moisture barrier, must pass the stringent performance requirements of various standards, for example NFPA 1971, CGSB 155.1-M88, EN 469, if the garment is to be certified compliant with those standards and judged suitable for its intended use. There is also a standard, NFPA 1851, which mandates periodic verification of the condition and performance of the garment and its various components. However, the habit of permanently sewing the moisture barrier to either the thermal barrier or the outer shell or both, precludes an easy and ready verification of the continuing ability of the moisture barrier to meet those performance requirements after the garment has been put into use.

Furthermore, it is known that the moisture barrier will most likely cease to perform the function for which it was designed, or be able to pass the tests to which is was certified, before other components of the garment exhibit a similar failure. For example, it is commonly stated that fire fighter turnout gear should have a useful life of at least four to five years. However, various data have indicated that in garments using moisture barriers with a non-PTFE polymer, and in use for less than four years, over 50% of the moisture barriers failed a 2-psi hydrostatic test.

If it is found that the moisture barrier has failed, it cannot be readily removed for repair or replacement. Therefore, if the moisture barrier is found to be leaking, one option is to replace the entire liner with a new one even though the thermal barrier component thereof is still performing adequately. This option is unnecessarily expensive. A second option is to send the entire liner or garment back to the manufacturer or to an agency skilled in the art, for the removal and repair or replacement of the moisture barrier. This option is expensive because of the transportation costs and the labor required to effect the replacement. It also greatly inconveniences the user because his garment cannot be used while the liner is out of service for moisture barrier repair or replacement.

U.S. Pat. No. 5,655,222 discloses a firefighter garment in which the moisture barrier is not permanently sewn to the thermal barrier for the entirety of their common periphery. Instead, at one or more locations on the said periphery, there are inspection ports, with hook-and-pile fastener strips holding the two components together to prevent the ingress of potentially damaging foreign material between the two. The inspection ports permit one to pull the moisture barrier out through these openings—in a manner similar to turning a dishwashing glove inside out—for inspection of the polymer. The aim of the patent is to permit a visual inspection of the moisture barrier polymer; it does not facilitate the actual testing of the moisture barrier. Furthermore, it is obvious that this design is not intended to, nor could it allow for, the ready removal and replacement of the moisture barrier should it be found to be defective. As well, the very act of pulling the moisture barrier out through the relatively small inspection port may cause the polymer to be damaged by the fingernails or jewelry of the untrained person doing the inspection.

SUMMARY OF THE INVENTION

It is an object of the present invention to readily permit the removal of the moisture barrier for both inspection and testing, and for repair where necessary or possible.

It a further object of the present invention to reduce the risk of inadvertently damaging the moisture barrier polymer when the moisture barrier is removed for said inspection, testing or repair.

It is an object of the present invention to permit the easy re-attachment of the moisture barrier—whether a new one or the repaired one—to the garment.

It is another object of the present invention to provide a liner for a firefighter coat or pant wherein the moisture barrier can be readily separated from or attached to the thermal barrier component.

It is another object of the present invention to provide a liner for a firefighter coat or pant wherein the moisture barrier can be readily separated from or attached to the outer shell component.

It is another object of the present invention to provide a liner for a firefighter coat or pant wherein a moisture barrier that no longer has the desired performance characteristics can be readily removed and replaced with a new or repaired one.

It is another object of the present invention to provide a liner for a firefighter coat or pant wherein the moisture barrier is joined to the thermal barrier or the outer shell along the major part of its periphery by means of a flame and heat resistant slide fastener.

It is another object of the present invention to provide a liner for a firefighter coat or pant wherein the moisture barrier is joined to the thermal barrier or the outer shell along the major part of its periphery by means of a waterproof and flame and heat resistant slide fastener.

It is another object of the present invention to provide a liner for a firefighter coat or pant wherein the moisture barrier can be easily removed to permit visual inspection of the entire surface area of the moisture barrier film.

It is another object of the present invention to provide a liner for a firefighter coat or pant wherein the moisture barrier can be quickly and easily re-attached to the liner subsequent to a visual inspection.

It is another object of the present invention to provide a liner for a firefighter coat or pant wherein the moisture barrier can be easily separated from the thermal barrier so as to permit a visual inspection of the entire surface area of the substrate side of the thermal barrier.

It is another object of the present invention to provide a liner for a firefighter coat or pant wherein the thermal barrier can be quickly and easily re-attached to the liner subsequent to such an inspection.

It is another object of the present invention to provide a liner for a firefighter coat or pant wherein the moisture barrier can be easily separated from the thermal barrier so as to permit hydrostatic testing from either the film or substrate side of the moisture barrier.

It is another object of the present invention to provide a liner for a firefighter coat or pant wherein the moisture barrier can be quickly and easily re-attached to the liner subsequent to such a hydrostatic testing.

The present invention relates to a firefighter garment comprising an outer shell, a moisture barrier and a thermal barrier, wherein fastening means are provided for removably attaching the moisture barrier to the outer shell, the thermal barrier, or both, and for readily removing the moisture barrier therefrom, and inspecting, testing, repairing or replacing same under conditions to prevent damage to the moisture barrier.

The fastening means may removably attach the moisture barrier to the outer shell only, or to the thermal barrier only, or to both the outer shell and the thermal barrier.

The fastening means preferably comprise a flame and heat resistant slide fastener, such as a heat resistant Zipper® or more preferably a waterproof and flame and heat resistant slide fastener. It may also comprise snaps or a hook-and-pile tape, or the like.

In accordance with a preferred embodiment, the slide fastener is provided along at least a major part of periphery of the moisture barrier and along corresponding parts of the periphery of the outer shell, thermal barrier or both.

The invention also relates to a method for constructing a firefighter garment which comprises providing an outer shell, a moisture barrier and a thermal barrier, tailoring the outer shell, moisture barrier and thermal barrier to a predetermined firefighter garment design, and assembling the outer shell, moisture barrier and thermal barrier into the above firefighter garment. According to the invention, the method comprises removably attaching the moisture barrier to either the outer shell or thermal barrier, or both, under conditions that the moisture barrier can readily be removed therefrom, and inspected, tested, repaired or replaced by a new one, and be attached again without damage thereto.

BRIEF DESCRIPTION OF DRAWINGS

The invention is illustrated but is not limited to the annexed drawings of a preferred embodiment, in which.

DESCRIPTION OF PREFERRED EMBODIMENTS

Figure 1:
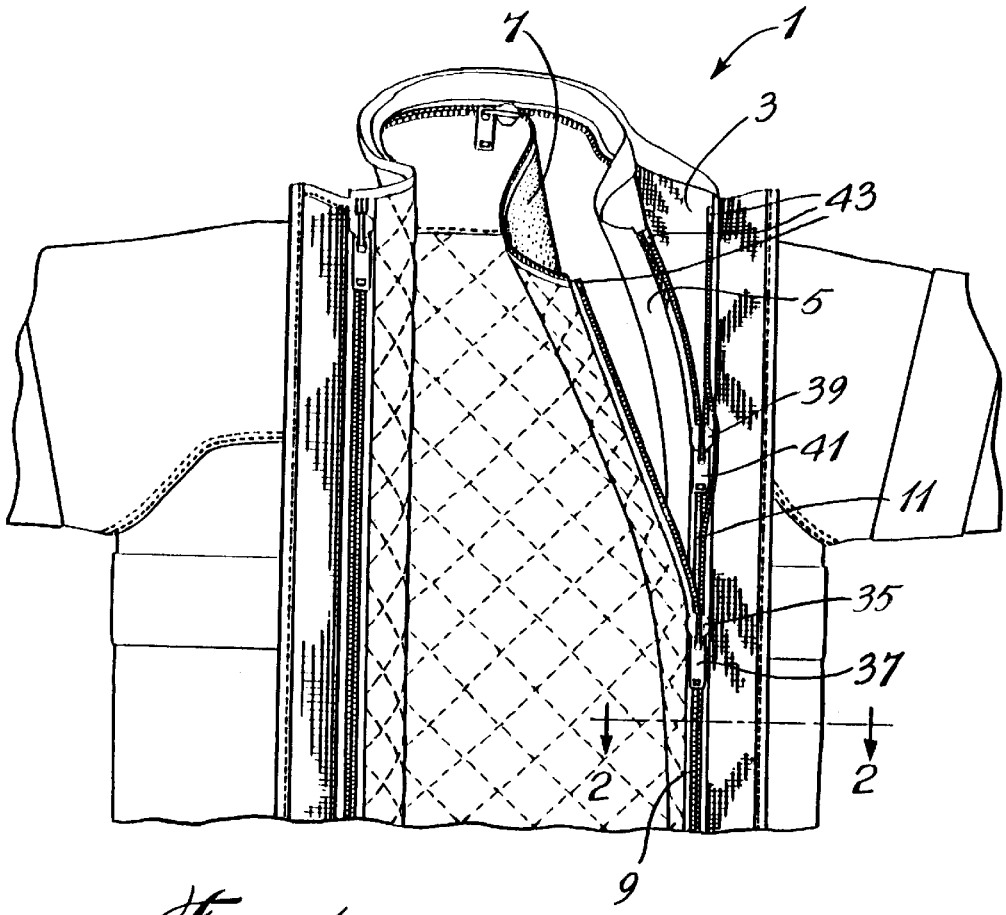
FIG. 1 is a front view in perspective of a firefighter coat according to the invention showing the outer shell, moisture barrier and thermal liner.

In the description which follows, unless otherwise indicated, like parts will be identified by the same reference numerals.

Figure 2:
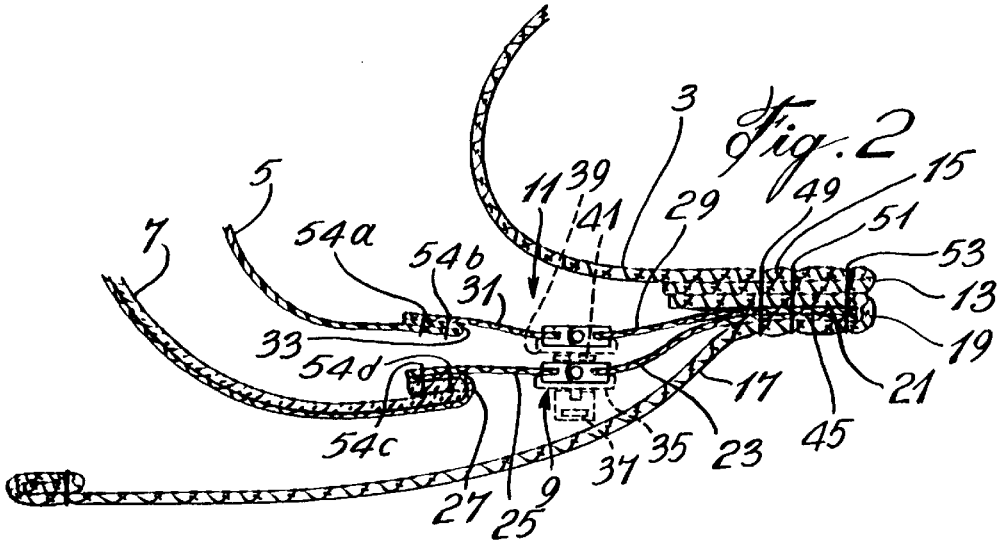
FIG. 2 is a cross-section view taken along line 2—2 of FIG. 1.

With reference to the drawings, more particularly FIGS. 1 and 2, it will be seen that a firefighter coat 1 according to the invention, in the first embodiment which is illustrated, essentially consists of an outer shell 3, a separable moisture barrier 5 and a thermal barrier 7. These three layers are of course respectively made of materials which are well known to those skilled in the art and as discussed above. As shown and as will be discussed more in detail, the idea behind the present invention is to provide a readily separable moisture barrier 5. To achieve this goal, in the first illustrated embodiment, firefighter coat 1 is provided with two sets of slide fasteners, such as a waterproof, flame and heat resistant Zippers®, respectively 9 and 11, which are used to assemble outer shell 3, moisture barrier 5 and thermal barrier 7. As will be seen later, firefighter coat 1, assembled in this manner, enables to easily separate moisture barrier 5 for inspection and testing, and for repair or replacement where necessary or possible, without damaging it.

More particularly, in the embodiment, which is illustrated in FIGS. 1 and 2, outer shell 3 is folded at 13 to define edge area 15 of outer shell 3. To protect and hide slide fasteners 9 and 11 when firefighter coat 1 is worn by a fireman when fighting a fire, there is provided facing 17 which is designed to flip over as shown and to cover slide fasteners 9 and 11 when the coat is in use. As illustrated, facing 17 consists of a piece of cloth, here Kevlar® and Nomex®, which is of the same material as outer shell 3. This piece of cloth is folded at 19 to define edge area 21 of the facing.

Turning now to slide fasteners 9 and 11, it will be seen that in the embodiment illustrated in FIGS. 1 and 2, fastener 9 lies exactly over slide fastener 11 when the coat is worn and as viewed in FIG. 1. As in most slide fasteners, slide fastener 9 consists of two meshing parts wherein the teeth engage into one another. The first part of slide fastener 9 consists of an outer shell teeth and tape combination 23, which is fixed by sewing to outer shell along edge area 15 thereof. The second part of slide fastener 9 comprises thermal barrier teeth and tape combination 25, which is fixed by sewing to thermal barrier 7 along edge 27 thereof.

With respect to slide fastener 11, which is identical to slide fastener 9, it will be noted first that it is disposed immediately underneath slide fastener 9 when the coat is worn and as shown in FIG. 1 as mentioned above. It consists of an outer shell teeth and tape combination 29, which is fixed by sewing to outer shell 3 at edge area 15 thereof. The second part of slide fastener 11 is a moisture barrier teeth and tape combination 31, which is fixed by sewing to moisture barrier 5 along edge 33 thereof.

Of course, both slide fasteners 9 and 11 each have their respective slide and tab 35, 37 and 39, 41 as well as the usual stops 43 (FIG. 1).

Finally, with reference to FIG. 2, the arrangement for fixing the tape portions of outer shell teeth and tape combinations 23 and 29 is illustrated. It will be seen that facing 17 is folded at 19 to define edge area 21 of facing 17. The tape portions of both outer shell teeth and tape combinations 23 and 29 are placed inside fold 45 in the required order, i.e. the tape portion of outer shell teeth and tape combination 29 is placed nearer the outer shell and the tape portion of outer shell teeth and tape combination 23 is nearer edge area 21 of facing 17. Once this is done, outer shell 3, tape portions of teeth and tape combinations 23 and 29 and edge area 21 of facing 17 are sewed at 49, 51 and 53 as shown.

Of course there are provided as many slide fasteners 9 and 11 as required as shown for example in FIG. 1 where there are slide fasteners at the top of the coat as well as on the other side of the coat.

In this manner it is merely necessary to first unfasten slide fasteners 9 to remove thermal barrier 7 and then to unfasten slide fasteners 11 to separate the moisture barrier which can then be inspected, tested and repaired and reassembled with the outer shell and the thermal barrier. If necessary, a new moisture barrier can replace one which has been too extensively damaged, thus achieving a substantial saving as compared to replacing an entirely new firefighter garment.

Figure 3:
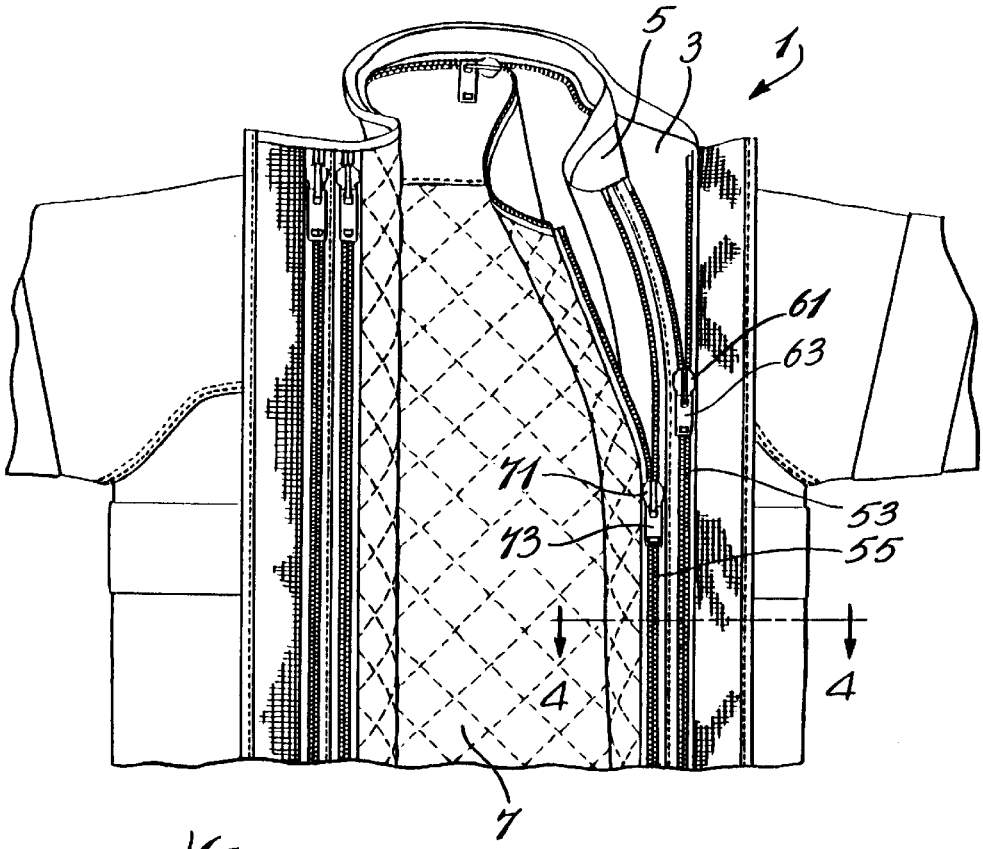
FIG. 3 is a front view in perspective of another embodiment of a firefighter coat according to the invention.
Figure 4:
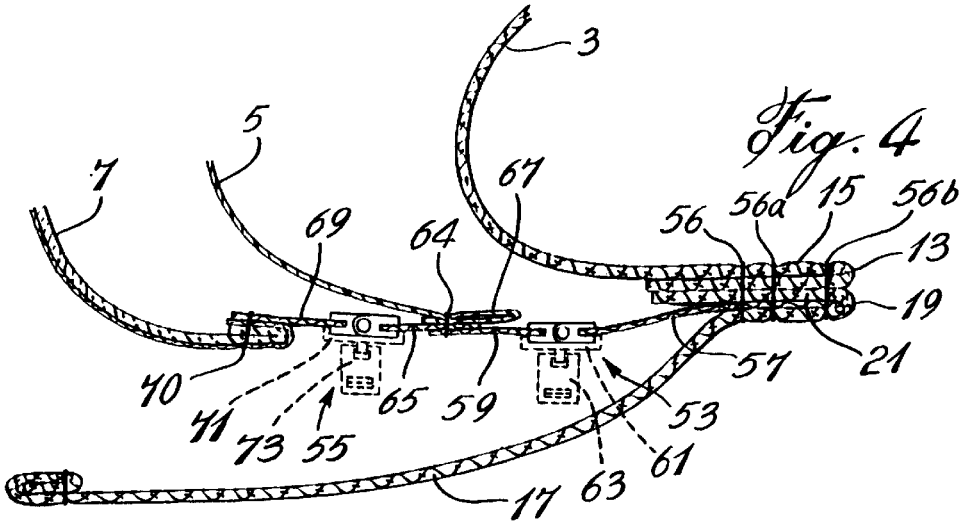
FIG. 4 is a cross-section view taken along line 4—4 of FIG. 3.

Turning to the embodiment illustrated in FIGS. 3 and 4, the main difference is that the two slide fasteners are arranged side by side instead of over one another as in the first embodiment illustrated in FIGS. 1 and 2. For this purpose there are provided slide fasteners 53 and 55 which are disposed and arranged as follows. Slide fastener 53 connects outer shell 3 through facing 17 to moisture barrier 5 on the one hand, and thermal barrier 7 through slide fastener 55 on the other hand. More particularly, outer shell 3 is folded at 13 to define outer edge area 15, and facing 17 is folded at 19 to define edge area 21 similarly as in the embodiment of FIGS. 1 and 2. To achieve all this, slide fastener 53 comprises outer shell teeth and tape combination 57 wherein the tape portion is engaged by facing 17 within the fold defined at edge area 21. At this juncture, it should be mentioned that edge area 15 of outer shell 3, tape portion of outer shell teeth and tape combination 57 and edge area 21 of facing 17 are sewed together as shown at 56, **56*a* and 56*b*. Slide fastener 53 additionally comprises an intermediate teeth and tape combination 59 which meshes with outer shell teeth and tape combination 57 by the action of slide 61 which is operated by tab 63. The tape portion of intermediate teeth and tape combination 59 is fixed in the manner indicated by sewing at 64 with tape portion of moisture barrier teeth and tape combination 65 of slide fastener 55, together with folded edge area 67 of moisture barrier 5. As shown, slide fastener 55 also comprises thermal barrier teeth and tape combination 69 wherein the tape portion is fixed as shown by sewing at 70 to thermal barrier 7 along a folded edge thereof. Thermal barrier teeth and tape combination 69 meshes with moisture barrier teeth and tape combination 65 by the action of slide 71 which is operated by tab 73**.

To separate the moisture barrier of this embodiment, it is merely necessary to unfasten both slide fasteners 53 and 55 and thereafter proceed as in the case of the first embodiment.

Figure 5:
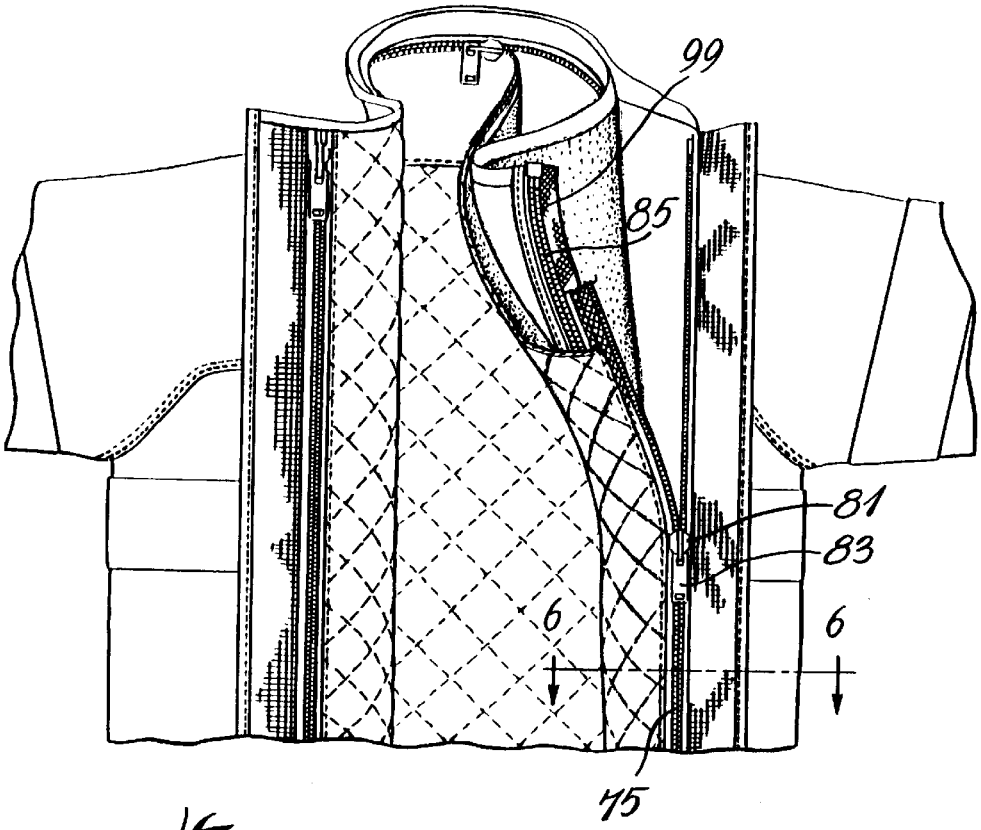
FIG. 5 is a front view in perspective of yet another embodiment of a firefighter coat according to the invention.
Figure 6:
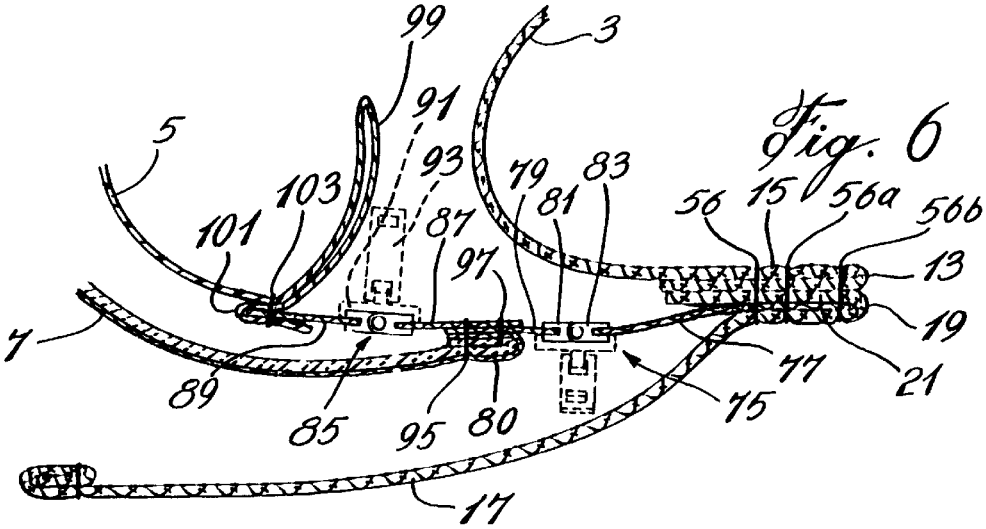
FIG. 6 is a cross-section view taken along lines 6—6 of FIG. 5.

Turning now to the third embodiment which is illustrated in FIGS. 5 and 6, it will be noted that the first slide fastener 75 is engaged with outer shell 3 and facing 17 similarly as in the embodiment of FIGS. 3 and 4. More particularly, in this case, slide fastener 75 comprises outer shell teeth and tape combination 77 which has its tape portion engaged by the fold provided at edge area 21 of facing 17. Otherwise this part of the firefighter coat is identical to the corresponding part of the embodiment illustrated in FIGS. 3 and 4. Slide fastener 75 also comprises thermal barrier teeth and tape combination 79 which meshes with outer shell teeth and tape combination 77 through slide 81 which is operated by tab 83. Attachment of teeth and tape combination 79 to moisture barrier 5 and thermal barrier will be described later.

The second fastener 85 according to this embodiment comprises a thermal barrier teeth and tape combination 87 and a moisture barrier teeth and tape combination 89 which mesh together as usual through slide 91 and tab 93. As illustrated particularly in FIG. 6, tape portion of thermal barrier teeth and tape combination 79 is placed between folded edge area 80 of thermal barrier 7 and tape portion of thermal barrier teeth and tape combination 87 where they are sewed together as shown at 95 and 97. It should also be noted here that slide fasteners 75 and 85 are mounted in reversed manner for a reason that will be explained later. Before explaining this, however, and again with reference to FIG. 6, it will be seen that in order to protect outer shell 3 against friction with slide fastener 85, moisture barrier 5 is folded to define a flap 99 which can cover slide fastener 85 as shown. Finally, the outer edge of moisture barrier is bent at 101 over tape portion of moisture barrier teeth and tape combination 89 where it is sewed at 103.

To remove moisture barrier 5 of this embodiment for inspection, testing and/or repair and/or replacement, facing 17 is opened to reveal slide fastener 75, which is unfastened. Then, the edge of thermal barrier 7 including thermal barrier teeth and tape combination 79 is rotated 180° thereby revealing and reversing slide fastener 85, and flap 99 is flipped over to reveal slide fastener 85 which is unfastened to free moisture barrier 5. After inspection, testing and repair if necessary the latter can then be recombined with outer shell 3 and thermal barrier 7, or may be replaced by a new one.

It is within the scope of the present invention to provide other fastening means well known to those in the art for assembling the three components of the firefighter coat so that the moisture barrier can be removably assembled with the outer shell and the thermal liner.

It is also within the scope of the present invention to assemble other parts of a firefighter garment such as the firefighter pant in a similar manner Finally, it is within the spirit of the present invention to provide modifications as long as they are within the scope of the appended claims.

What is claimed is:

1. In a firefighter garment comprising an outer shell, a moisture barrier and a thermal barrier, the improvement which comprises fastening means arranged for removably attaching said moisture barrier to said outer shell, said thermal barrier, or both, and for readily removing said moisture barrier therefrom and inspecting, testing and repairing same if necessary, or replacing same with a new one under conditions to prevent damage to said moisture barrier, said fastening means removably attaching said moisture barrier to said outer shell and to said thermal barrier, wherein said fastening means comprise a third slide fastener and a fourth slide fastener, said third slide fastener comprising a third outer shell teeth and tape combination fixed to said outer shell along an edge thereof and an intermediate teeth and tape combination meshing with said third outer shell teeth and tape combination, said fourth slide fastener comprising a second moisture barrier teeth and tape combination fixed on the one hand to and along said intermediate teeth and tape combination and on the other hand to and over said moisture barrier along an edge thereof, said fourth slide fastener also comprising a second thermal barrier teeth and tape combination fixed to said thermal harrier along and edge thereof and meshing with said second moisture barrier teeth and tape combination, said third and fourth slide fasteners being arranged side by side to separately and removably attach and moisture barrier to said outer shell and said thermal barrier, with said moisture barrier being positioned between said outer shell and said thermal barrier.

2. In a firefighter garment according to claim 1, wherein said outer shell is formed with a facing flapping over and covering said third and fourth slide fasteners.

3. The firefighter garment according to claim 1, wherein said third and fourth slide fasteners are heat resistant.

4. The firefighter garment according to claim 1, wherein said third and fourth slide fasteners are flame and heat resistant.

* * * * *